US006352118B1

(12) United States Patent
Dickson et al.

(10) Patent No.: US 6,352,118 B1
(45) Date of Patent: Mar. 5, 2002

(54) SYSTEM AND METHOD FOR COMMUNICATION HYDRAULIC CONTROL TO A WIRELINE RETRIEVABLE DOWNHOLE DEVICE

(75) Inventors: Rennie L. Dickson, Carrollton; Dennis Kaminski, Arlington, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/540,002

(22) Filed: Mar. 30, 2000

(51) Int. Cl.[7] ..... E21B 34/10

(52) U.S. Cl. ..... 166/373; 166/386; 166/322; 166/323; 166/332.8

(58) Field of Search ..... 166/373, 374, 166/375, 386, 321, 322, 323, 332.1, 332.8, 297, 334.1

(56) References Cited

U.S. PATENT DOCUMENTS 4,603,740 A * 8/1986 Edwards et al. ..... 166/319
4,605,070 A * 8/1986 Morris ..... 166/380
4,606,410 A * 8/1986 Becker et al. ..... 166/313
5,314,026 A * 5/1994 Williamson, Jr. ..... 166/386

* cited by examiner

*Primary Examiner*—William Neuder
(74) *Attorney, Agent, or Firm*—Paul I. Herman; Lawrence R. Youst

(57) ABSTRACT

A system and method for communicating hydraulic control to a wireline retrievable downhole device (112) are disclosed. The system utilizes a tubing retrievable downhole device (50) having a hydraulic chamber (70). A radial cutting tool (104) is selectively located within the tubing retrievable downhole device (50) to cut a fluid passageway (110) between the hydraulic chamber (70) and the interior of the tubing retrievable downhole device (50). Thereafter, when the wireline retrievable downhole device (112) is positioned within the tubing retrievable downhole device (50), hydraulic control is communicated to the wireline retrievable downhole device (50) through the fluid passageway (110) to actuate the wireline retrievable downhole device (50).

24 Claims, 5 Drawing Sheets

10
18
40
46
20
12
24
22
42
48
26
16
30
44
28
38
32
36
14
34

SYSTEM AND METHOD FOR COMMUNICATION HYDRAULIC CONTROL TO A WIRELINE RETRIEVABLE DOWNHOLE DEVICE

TECHNICAL FIELD OF THE INVENTION

This invention relates in e, to the operation of hydraulically controllable downhole devices and in particular to a system and method for communicating hydraulic control from a tubing retrievable downhole device to a wireline retrievable downhole device.

BACKGROUND OF THE INVENTION

One or more subsurface safety valves are commonly installed as part of the tubing string within oil and gas wells to protect against the communication of high pressure and high temperature formation fluids to the surface. These subsurface safety valves are designed to shut in production from the formation in response to a variety of abnormal and potentially dangerous conditions.

As one or more subsurface safety valves are built into the tubing string, these valves are typically referred to as tubing retrievable safety valves ("TRSV"). TRSVs are normally operated by hydraulic fluid pressure. The hydraulic fluid pressure is typically controlled at the surface and transmitted to the TRSV via a hydraulic fluid line. Hydraulic fluid pressure must be applied to the TRSV to place the TRSV in the open position. When hydraulic fluid pressure is lost, the TRSV will operate to the closed position to prevent formation fluids from traveling therethrough. As such, TRSVs are fail safe valves.

As TRSVs are often subjected to years of service in severe operating conditions, failure of TRSVs may occur. For example, a TRSV in the closed position may leak. Alternatively, a TRSV in the closed position may not properly open. Because of the potential for disaster in the absence of a properly functioning TRSV, it is vital that the malfunctioning TRSV be promptly replaced or repaired.

As TRSVs are typically incorporated into the tubing string, removal of the tubing string to replace or repair the malfunctioning TRSV is required. Depending on the circumstances, the cost of pulling the tubing string out of the wellbore can run into the millions of dollars.

It has been found, however, that a wireline retrievable safety valve ("WRSV") may be inserted inside the original TRSV and operated to provide the same safety function as the original TRSV. These valves are designed to be lowered into place from the surface via wireline and locked in place inside the original TRSV. This method is a much more efficient and cost-effective alternative to pulling the tubing string.

If the WRSV is to take over the full functionality of the original TRSV, the WRSV must be communicated to the hydraulic control system. In traditional TRSVs, the communication path for the hydraulic fluid pressure to the replacement WRSV is established through a pre-machined radial bore extending from the hydraulic chamber to the interior of the TRSV. Once a failure in the TRSV has been detected, this communication path is established by shifting the TRSV to its locked out position and sheering a sheer plug that is installed within the radial bore.

It has been found, however, that operating conventional TRSVs to the locked out position and establishing this communication path has several inherent drawbacks. To begin with, the communication path creates a leak path for formation fluids up through the hydraulic control system. As noted above, TRSVs are intended to operate under abnormal well conditions and serve a vital and potentially life-saving function. Hence, if such an abnormal condition occurred when one TRSV has been locked out, even if other safety valves have closed the tubing string, high pressure formation fluids may travel to the surface through the hydraulic line. In addition, manufacturing a TRSV with this radial bore requires several high-precision drilling and thread tapping operations in a difficult-to-machine material. Any mistake in the cutting of these features necessitates that the entire upper subassembly of the TRSV be scrapped. The manufacturing of the radial bore also adds considerable expense to the TRSV, while at the same time reducing reliability of the finished product. For example, if the seal between the sheer plug and the radial bore fails, a communication path for formation fluids may be created between the annulus and the interior of the TRSV. Additionally, this added expense and complexity must be built into every installed TRSV, while it will only be put to use in some small fraction thereof.

Therefore, a need has arisen for a system and method for establishing a communication path for hydraulic fluid pressure to a WRSV from a failed TRSV. A need has also arisen for such a system and method that does not create the potential for formation fluids to travel up through the hydraulic control line. Further, a need has arisen for such a system and method that does not require the complexity, expense, leak potential and reliability concerns associated with manufacturing a TPSV with a radial bore having a sheer plug therein.

SUMMARY OF THE INVENTION

The present invention disclosed herein comprises a system and method for establishing a communication path for hydraulic fluid pressure to a wireline retrievable downhole device from a tubing retrievable downhole device. The system and method of the present invention avoids the potential for formation fluids to travel up through the hydraulic control line. The system and method of the present invention also avoids the complexity, expense, leak potential and reliability concerns associated with a pre-drilled radial bore in the tubing retrievable downhole device that requires a sheer plug to be disposed therein to provide a seal.

The system of the present invention for communicating hydraulic control from a tubing retrievable downhole device to a wireline retrievable downhole utilizes a tubing retrievable downhole device having a hydraulic chamber. After a malfunction of the tubing retrievable downhole device is detected and a need exists to otherwise achieve the functionality of the tubing retrievable downhole device, a radial cutting tool may be selectively located within the tubing retrievable downhole device. The radial cutting tool is used to create a fluid passageway between the hydraulic chamber of the tubing retrievable downhole device and the interior of the tubing retrievable downhole device. As such, hydraulic fluid may now be communicated down the existing hydraulic lines to the interior of the tubing. Once this communication path exists, the wireline retrievable downhole device may be positioned within the tubing retrievable downhole device such that the hydraulic fluid pressure from the hydraulic system may be communicated to the wireline retrievable downhole device.

The radial cutting tool that is selectively located within the tubing retrievable downhole device may be a chemical cutting tool, a mechanical cutting tool, explosive cutting mechanism or the like that are well known in the art.

In one embodiment of the present invention, the tubing retrievable downhole device may be a tubing retrievable safety valve that is operated to the lock out position prior to creating the fluid passageway between the hydraulic chamber of the tubing retrievable safety valve and the interior of the tubing retrievable safety valve. In this embodiment of the present invention, the wireline retrievable downhole device is typically a wireline retrievable safety valve that is used to replace the functionality of a malfunctioning tubing retrievable safety valve.

The method of the present invention for communicating hydraulic control from a tubing retrievable downhole device to a wireline retrievable downhole device involves locating a radial cutting tool within the tubing retrievable downhole device, creating a fluid passageway from the hydraulic chamber of the tubing retrievable downhole device to the interior of the tubing retrievable downhole device with the radial cutting tool and positioning the wireline retrievable downhole device within the tubing retrievable downhole device adjacent to the fluid passageway, thereby communicating hydraulic control to the wireline retrievable downhole device.

In the method of the present invention, the step of creating the fluid passageway may be achieved by chemically cutting the fluid passageway, mechanically cutting the fluid passageway, explosively cutting the fluid passageway or the like.

The method of the present invention may, for example, be used to communicate hydraulic fluid pressure to actuate a wireline retrievable safety valve that has been positioned within a tubing retrievable safety valve that has been operated to its lock out position.

BRIEF DESCRIPTION OF THE DRAWINGS

For a more complete understanding of the present invention, including its features and advantages, reference is row made to the detailed description of the invention, taken in conjunction with the accompanying drawings in which like numerals identify like parts and in which.

DETAILED DESCRIPTION OF THE INVENTION

While the making and using of various embodiments of the present invention is discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
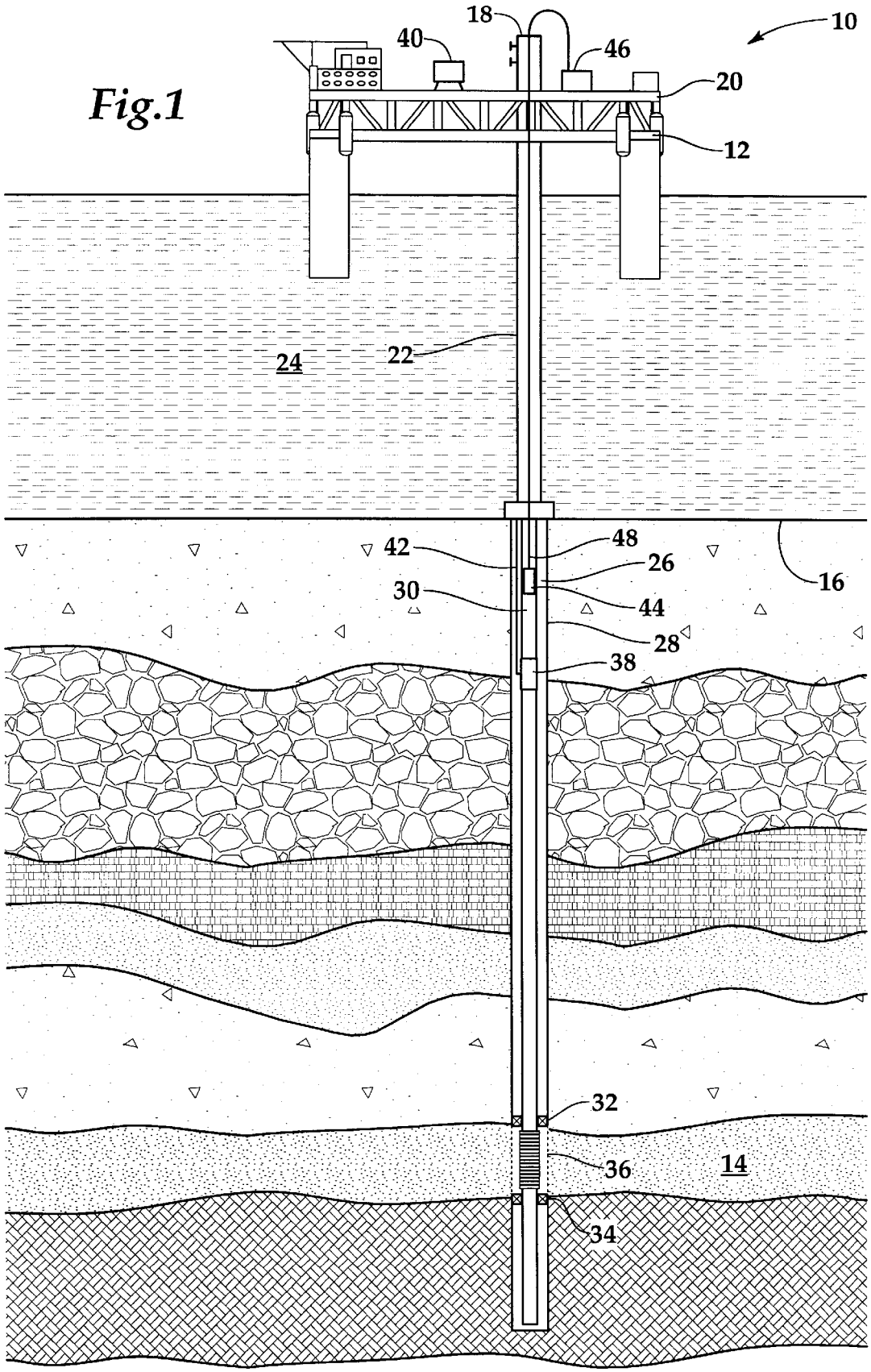
FIG. 1 is a schematic illustration of an offshore production platform wherein a wireline retrievable safety valve is being lowered into a tubing retrievable safety valve to take over the functionality thereof.

Referring to FIG. 1, an offshore oil and gas production platform having wireline retrievable safety valve lowered into a tubing retrievable safety valve is schematically illustrated and generally designated 10. A semi-submersible platform 12 is centered over a submerged oil and gas formation 14 located below sea floor 16. Wellhead 18 is located on deck 20 of platform 12. Well 22 extends through the sea 24 and penetrates the various earth strata including formation 14 to form wellbore 26. Disposed within wellbore 26 is casing 28. Disposed within casing 28 and extending from wellhead 18 is production tubing 30. A pair of seal assemblies 32, 34 provide a seal between tubing 30 and casing 28 to prevent the flow of production fluids therebetween. During production, formation fluids enter wellbore 26 through perforations 36 of casing 28 and travel into tubing 30 to wellhead 18.

Coupled within tubing 30 is a tubing retrievable safety valve 38. As is well known in the art, multiple tubing retrievable safety valves are commonly installed as part of tubing 30 to shut in production from formation 14 in response to a variety of abnormal and potentially dangerous conditions. For convenience of illustration, however, only tubing retrievable safety valve 38 is shown.

Tubing retrievable safety valve 38 is operated by hydraulic fluid pressure communicated thereto from surface installation 40 and hydraulic fluid control conduit 42. Hydraulic fluid pressure must be applied to tubing retrievable safety valve 38 to place tubing retrievable safety valve 38 in the open position. When hydraulic fluid pressure is lost, tubing retrievable safety valve 38 will operate to the closed position to prevent formation fluids from traveling therethrough.

If, for example, tubing retrievable safety valve 38 is unable to properly seal in the closed position or does not properly open after being in the closed position, tubing retrievable safety valve 38 must typically be repaired or replaced. In the present invention, however, the functionality of tubing retrievable safety valve 38 may be replaced by wireline retrievable safety valve 44, which may be installed within tubing retrievable safety valve 38 via wireline assembly 46 including wireline 48. Once in place within tubing retrievable safety valve 38, wireline retrievable safety valve 44 will be operated by hydraulic fluid pressure communicated thereto from surface installation 40 and hydraulic fluid line 42 through tubing retrievable safety valve 38. As with the original configuration of tubing retrievable safety valve 38, the hydraulic fluid pressure must be applied to wireline retrievable safety valve 44 to place wireline retrievable safety valve 44 in the open position. If hydraulic fluid pressure is lost, wireline retrievable safety valve 44 will operate to the closed position to prevent formation fluids from traveling therethrough.

Even though FIG. 1 depicts a cased vertical well, it should be noted by one skilled in the art that the present invention is equally well-suited for uncased wells, deviated wells or horizontal wells.

Figure 2A:
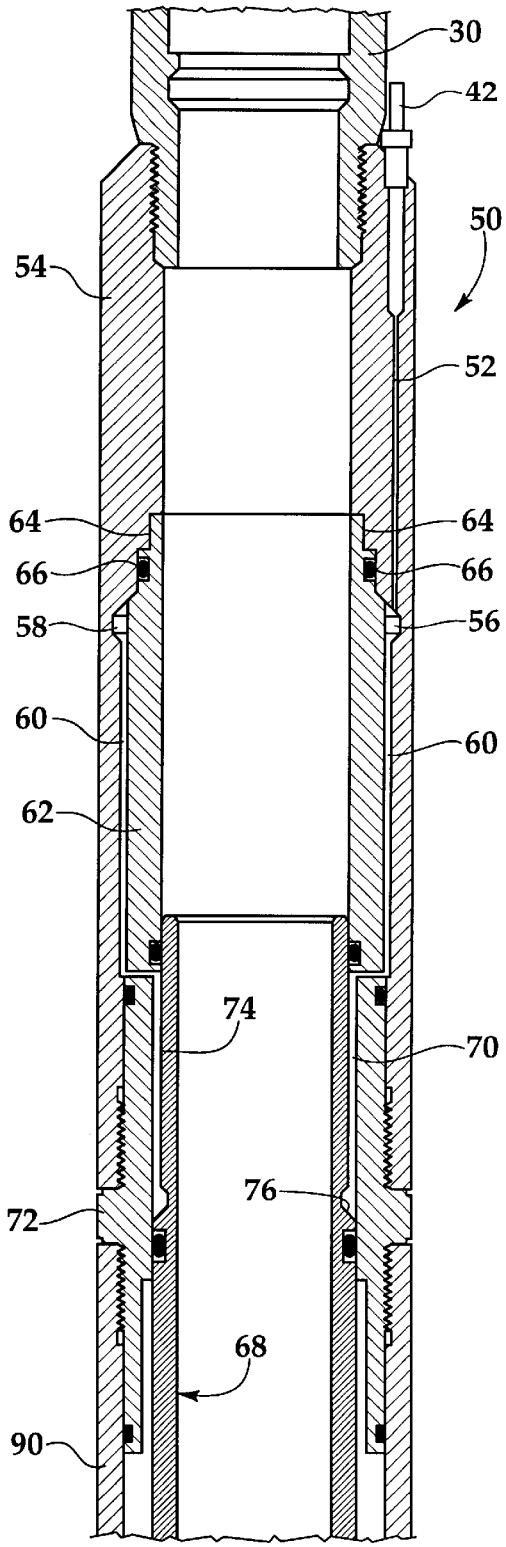
FIG. 2 is a half-section view of a tubing retrievable safety valve in its lock out position.
Figure 2B:
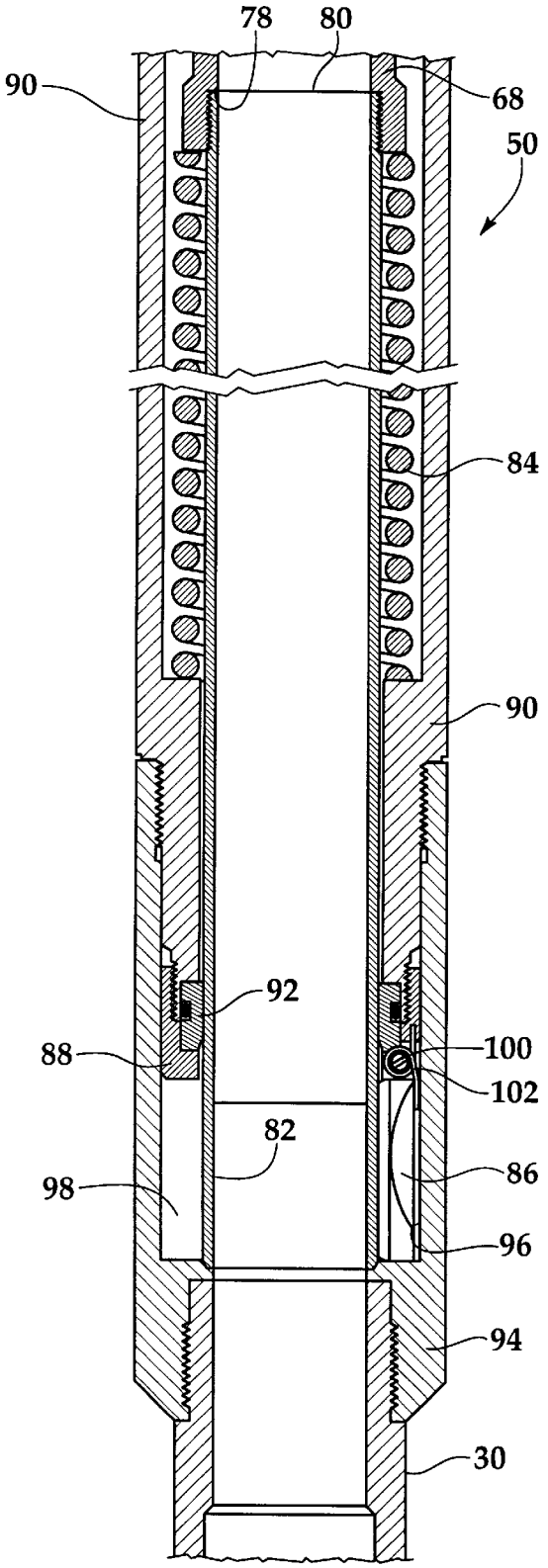

Referring now to FIGS. 2A and 2B, half sectional views of tubing retrievable safety valve 50 are illustrated. Safety valve 50 is connected directly in series with production tubing 30. Hydraulic control pressure is conducted in communicated to subsurface safety valve 50 via control conduit 42 to a longitudinal bore 52 formed in the sidewall of the top connector sub 54. Pressurized hydraulic fluid is delivered through the longitudinal bore 52 into an annular chamber 56 defined by a counterbore 58 which is in communication with an annular undercut 60 formed in the sidewall of the top connector sub 54. An inner housing mandrel 62 is slidably coupled and sealed to the top connector sub 54 by a slip union 64 and seal 66, with the undercut 60 defining an annulus between inner mandrel 62 and the sidewall of top connector sub 54.

A piston 68 is received in slidable, sealed engagement against the internal bore of inner mandrel 62. The undercut annulus 60 opens into a piston chamber 70 in the annulus between the internal bore of a connector sub 72 and the external surface of piston 68. The external radius of an upper sidewall piston section 74 is machined and reduced to define a radial clearance between piston 68 and connector sub 72. An annular sloping surface 76 of piston 68 is acted against by the pressurized hydraulic fluid delivered through control conduit 42. In FIGS. 2A–2B, piston 68 is in its locked out position wherein piston 68 is fully extended with the piston shoulder 78 engaging the top annular face 80 of an operator tube 82. In this locked out position, a return spring 84 is fully compressed.

A flapper plate 86 is pivotally mounted onto a hinge sub 88 which is threadably connected to the lower end of spring housing 90. A valve seat 92 is confined within a counterbore formed on hinge sub 88. The lower end of safety valve 50 is connected to production tubing 30 by a bottom sub connector 94. The bottom sub connector 94 has a counterbore 96 which defines a flapper valve chamber 98. Thus, the bottom sub connector 94 forms a part of the flapper valve housing enclosure. In normal operation, flapper plate 86 pivots about pivot pin 100 and is biased to the valve closed position by coil spring 102. When subsurface safety valve 50 must be operated from the valve open position to the valve closed position, hydraulic pressure is released from conduit 42 such that return spring 84 acts on the lower end of piston 68 which retracts operator tube 82 longitudinally through flapper valve chamber 98. Flapper closure plate 86 will then rotate through chamber 98. In the locked out position as shown in FIGS. 2A–2B, however, the spring bias force is overcome and flapper plate 86 is locked out by operator tube 82.

Even though subsurface safety valve 50 has been depicted, for the purposes of illustration, as having a flapper-type closure plate, it should be understood by one skilled in the art that subsurface safety valve 50 may incorporate various types of valve closure elements. Additionally, even though subsurface safety valve 50 has been depicted, for the purposes of illustration, as having hydraulic fluid acting directly upon piston 68, it should be understood by one skilled in the art that subsurface safety valve 50 may alternatively incorporate a rod-piston mechanism which is acted upon by the hydraulic fluid and which in turn operates piston 68.

Figure 3A:
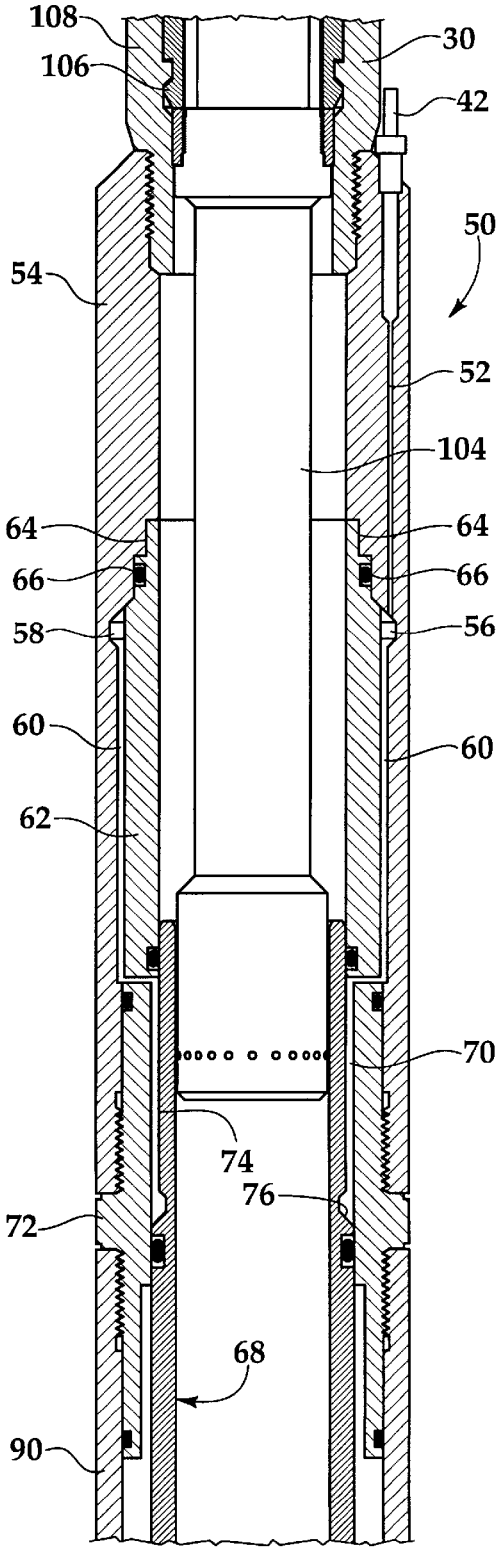
FIG. 3 is a half-section view of a tubing retrievable safety valve having a radial cutting tool positioned therein adjacent to the hydraulic chamber of the tubing retrievable safety valve.
Figure 3B:
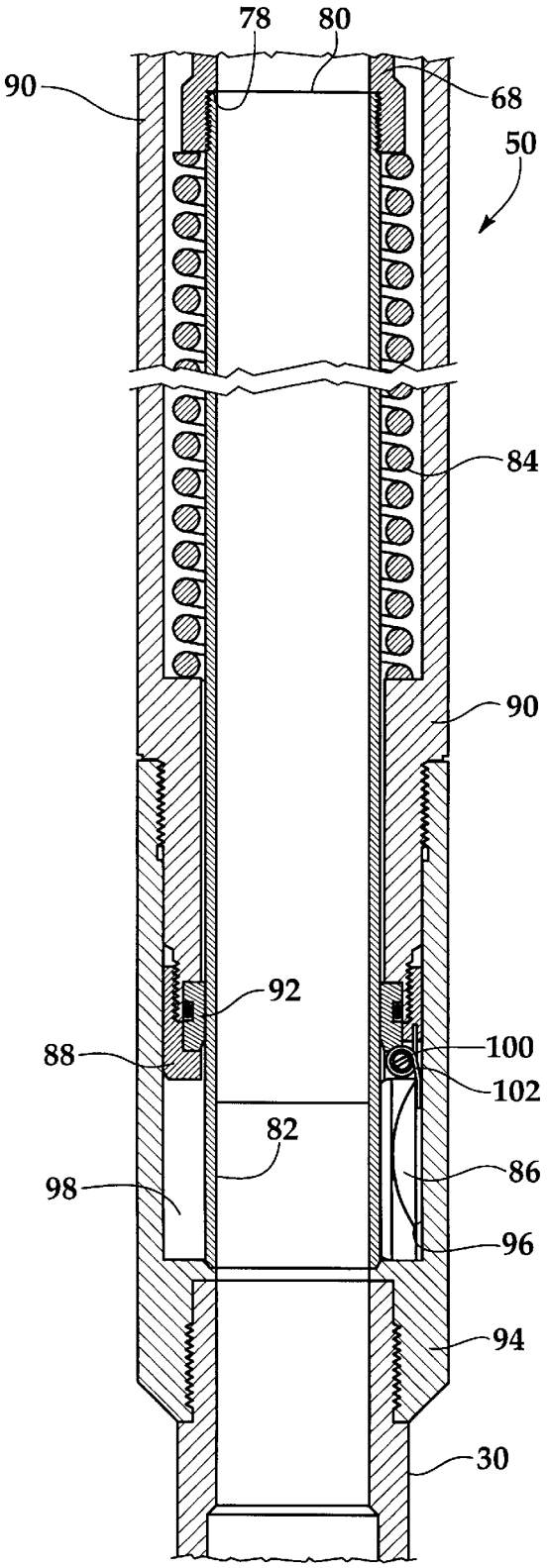

If safety valve 50 becomes unable to properly seal in the closed position or does not properly open after being in the closed position, it is desirable to reestablish the functionality of safety valve 50 without removal of tubing 30. In the present invention, as depicted in FIGS. 3A–3B, this is achieved by inserting a radial cutting tool 104 into the central bore of safety valve 50. Radial cutting tool 104 may use any one of several cutting techniques that are well known in the art including, but not limited to, chemical cutting, thermal cutting, mechanical cutting, explosive cutting or the like.

Figure 4A:
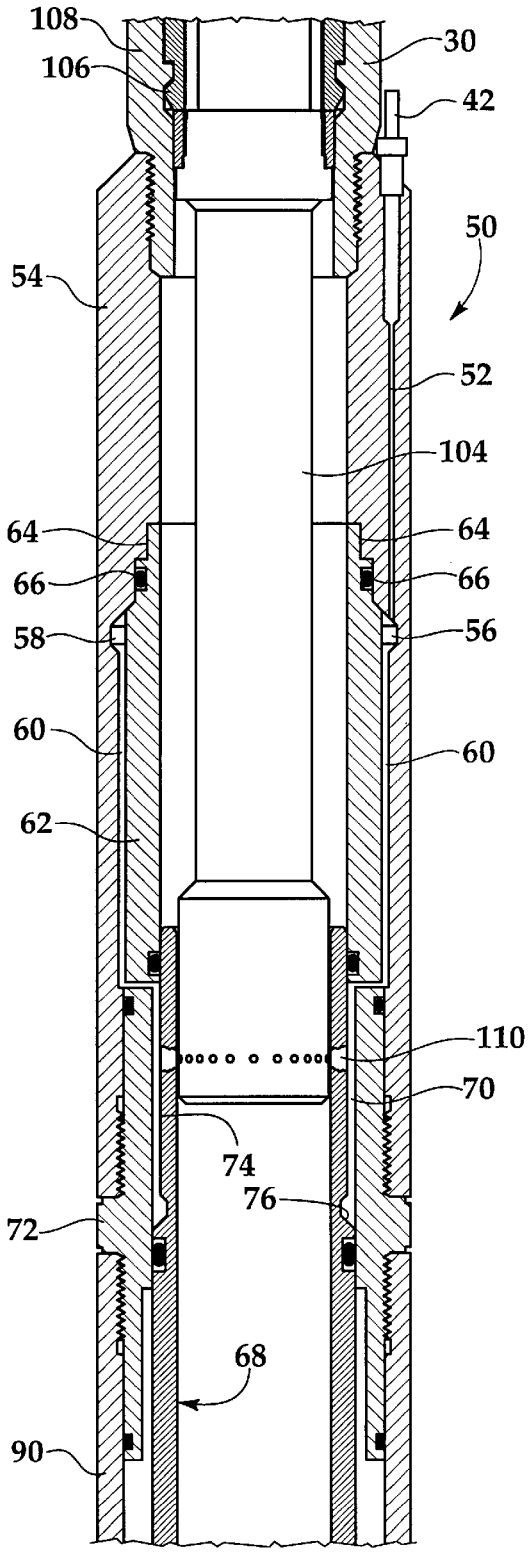
FIG. 4 is a half-section view of a tubing retrievable safety valve having a radial cutting tool positioned therein after creating a fluid passageway between the hydraulic chamber of the tubing retrievable safety valve and the interior of the tubing.
Figure 4B:
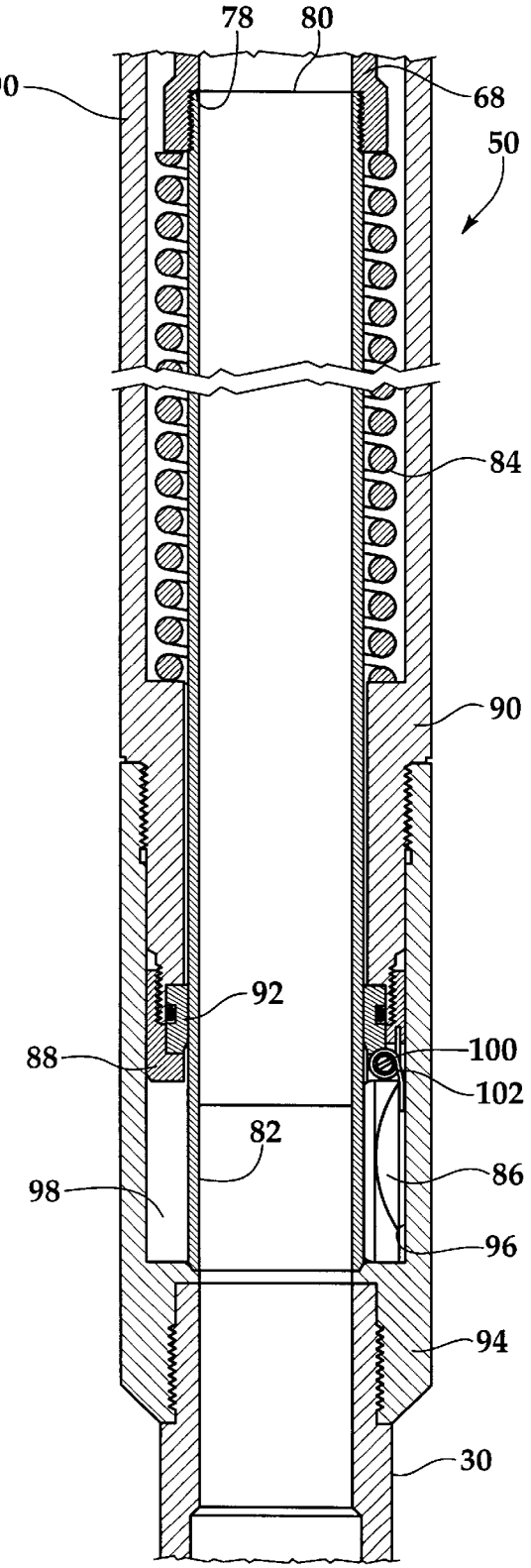

For example, radial cutting tool 104 may be a chemical cutter that is lowered through tubing 30 from the surface into the center of the locked out safety valve 50. An example of a suitable chemical cutter is disclosed in U.S. Pat. No. 5,575,331, which is hereby incorporated by reference. The position of radial cutting tool 104 within safety valve 50 is determined by the engagement of the locator section 106 of radial cutting tool 104 with a landing nipple 108 within tubing 30. Once in place, radial cutting tool 104 is operated to cut through upper sidewall piston section 74. In the case of using the chemical cutter, a dispersed jet of cutting fluid is released through cutting ports, making a 360 degree cut into the surrounding material. The chemical cutter is fired by an electrical signal carried by a cable, which is normally controlled at the surface. The depth of cut made by the chemical cutter is predetermined, and is controlled by the composition of chemicals loaded into the chemical cutter and the geometry of the cutting ports. The chemical cutter is set to make a cut deep enough to penetrate through upper sidewall piston section 74 of the piston 68 while still shallow enough to maintain the integrity of connector sub 72, as best seen in FIGS. 4A–4B.

Figure 5A:
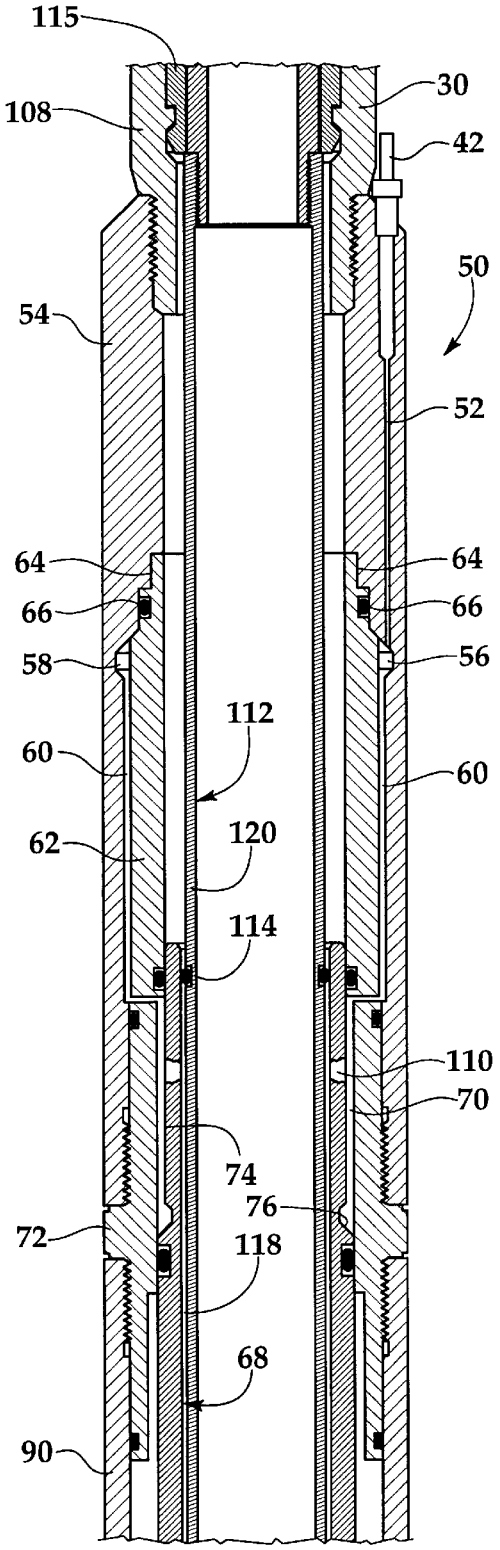
FIG. 5 is a half-section view of a tubing retrievable safety valve having a wireline retrievable safety valve disposed therein such that hydraulic control over the wireline retrievable safety valve may be established with the hydraulic system originally utilized to control the tubing retrievable safety valve.
Figure 5B:
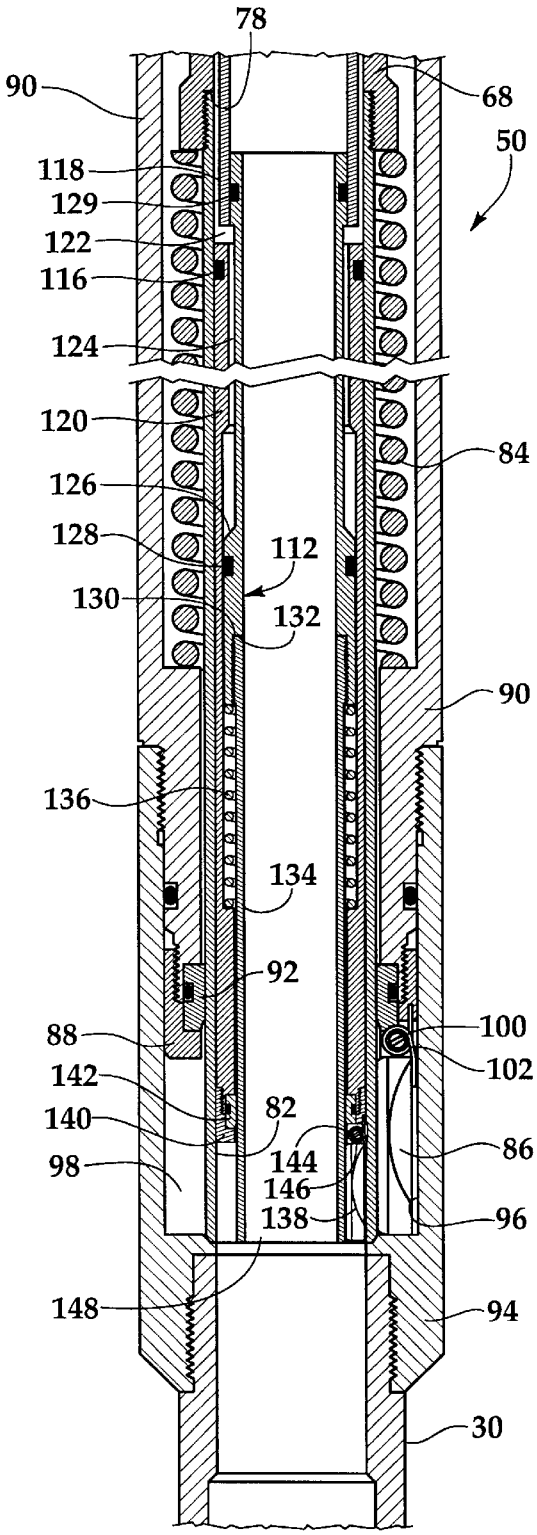

With the use of any suitable radial cutting tool 104, a fluid passageway 110 is created from piston chamber 70 to the interior of safety valve 50 through upper sidewall piston section 74. Hydraulic pressure communicated to piston chamber 70 may thereby be communicated to the interior of safety valve 50. Once fluid passageway 110 is created through upper sidewall piston section 74, radial cutting tool 104 is retrieved to the surface. As depicted in FIGS. 5A–5B, a wireline retrievable safety valve 112 is then lowered into the central bore of tubing retrievable safety valve 50. Wireline retrievable valve locator ring 115 engages landing nipple 108 within tubing 30 and locks into place. Installed in this manner, safety valve 112 seals the previously open fluid passageway 110 created by radial cutting tool 104 between seal 114 and seal 116. Hydraulic control pressure is now conducted to safety valve 112 through fluid passageway 110. Pressurized hydraulic fluid may now be delivered through an annular chamber 118 defined between piston 68 of safety valve 50 and housing 120 of safety valve 112. Annular chamber 118 is in communication with a radial port 122 and an annular chamber 124 formed between housing 120 and piston 126 of safety valve 112. Piston 126 is slidably coupled and sealed to housing 120 by seals 128 and 129. Piston 126 is fully extended with the piston shoulder 130 engaging the top annular face 132 of an operator tube 134. In this valve open position, a return spring 136 is fully compressed.

A flapper plate 138 is pivotally mounted onto a hinge sub 140. A valve seat 142 is confined within hinge sub 140. Flapper plate 138 pivots about pivot pin 144 and is biased to the valve closed position by coil spring 146. In the valve open position as shown in FIGS. 5A–5B, the spring bias force is overcome and flapper plate 138 is retained in the valve open position by operator tube 134 to permit formation fluid slow up through tubing 30.

When an out of range condition occurs and safety valve 112 must be operated from the valve open position to the valve closed position, hydraulic pressure is released from conduit 44 such that return spring 136 acts on the lower end of piston 126 which retracts operator tube 134 longitudinally through flapper valve chamber 148. Flapper closure plate 138 will then rotate through chamber 148 and seal against seat 142 to prevent the flow of formation fluids therethrough. As such, safety valve 112 replaces the functionality of safety valve 50 utilizing the hydraulic system originally used to operate safety valve 50. Thus, with the use of the present invention, hydraulic control may be communicated to a wireline retrievable downhole device through an existing tubing retrievable downhole device without removal of tubing 30. In addition, with the use of the present invention, hydraulic control may be communicated to a wireline retrievable downhole device through an existing tubing retrievable downhole device without creating unnecessary leak paths or designing complex and expensive tubing retrievable downhole devices.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method for communicating hydraulic control from a tubing retrievable downhole device having a hydraulic chamber to a wireline retrievable downhole device, the method comprising the steps of:

locating a radial cutting tool within the tubing retrievable downhole device;

creating a fluid passageway from the hydraulic chamber to the interior of the tubing retrievable downhole device with the radial cutting tool;

removing the radial cutting tool from the tubing retrievable downhole device; and positioning the wireline retrievable downhole device within the tubing retrievable downhole device adjacent to the fluid passageway, thereby communicating hydraulic control to the wireline retrievable downhole device.

2. The method as recited in claim 1 wherein the step of creating a fluid passageway from the hydraulic chamber to the interior of the tubing retrievable downhole device with the radial cutting tool further comprises chemically cutting the fluid passageway.

3. The method as recited in claim 1 wherein the step of creating a fluid passageway from the hydraulic chamber to the interior of the tubing retrievable downhole device with the radial cutting tool further comprises mechanically cutting the fluid passageway.

4. The method as recited in claim 1 wherein the step of creating a fluid passageway from the hydraulic chamber to the interior of the tubing retrievable downhole device with the radial cutting tool further comprises explosively cutting the fluid passageway.

5. The method as recited in claim 1 wherein the tubing retrievable downhole device further comprises a tubing retrievable safety valve.

6. The method as recited in claim 5 further comprising the step of operating the tubing retrievable safety valve to a lock out position.

7. The method as recited in claim 1 wherein the wireline retrievable downhole tool further comprises a wireline retrievable safety valve.

8. The method as recited in claim 1 further comprising the step of applying a hydraulic pressure to the wireline retrievable downhole device through the tubing retrievable downhole device to actuate the wireline retrievable downhole device.

9. A method for communicating hydraulic control to a wireline retrievable safety valve through a tubing retrievable safety valve, the method comprising the steps of:

locating a radial cutting tool within the tubing retrievable safety valve;

cutting a hole in the tubing retrievable safety valve with the radial cutting tool to create a fluid passageway from a hydraulic chamber of the tubing retrievable safety valve to the interior of the tubing retrievable safety valve; and positioning the wireline retrievable safety valve within the tubing retrievable safety valve; and applying a hydraulic pressure to the wireline retrievable safely valve through the tubing retrievable safety valve to actuate the wireline retrievable safety valve.

10. The method as recited in claim 9 wherein the step of cutting a hole in the tubing retrievable safety valve further comprises chemically cutting the hole.

11. The method as recited in claim 9 wherein the step of cutting a hole in the tubing retrievable safety valve further comprises mechanically cutting the hole.

12. The method as recited in claim 9 wherein the step of cutting a hole in the tubing retrievable safety valve further comprises explosively cutting the hole.

13. The method as recited in claim 9 further comprising the step of operating the tubing retrievable safety valve to a lock out position.

14. A system for communicating hydraulic control to a wireline retrievable downhole device comprising:

a tubing retrievable downhole device having a hydraulic chamber; and a radial cutting tool selectively locatable within the tubing retrievable downhole device, the radial cutting tool creating a fluid passageway from the hydraulic chamber to the interior of the tubing retrievable downhole device such that when the wireline retrievable downhole device is positioned within the tubing retrievable downhole device hydraulic control is communicatable thereto through the fluid passageway.

15. The system as recited in claim 14 wherein the radial cutting tool further comprises a chemical cutting tool.

16. The system as recited in claim 14 wherein the radial cutting tool further comprises a mechanical cutting tool.

17. The system as recited in claim 14 wherein the radial cutting tool further comprises explosive cutting mechanism.

18. The system as recited in claim 14 wherein the tubing retrievable downhole device further comprises a tubing retrievable safety valve.

19. The system as recited in claim 18 wherein the tubing retrievable safety valve is operated to the lock out position prior to creating a fluid passageway therein.

20. The system as recited in claim 14 wherein the wireline retrievable downhole tool further comprises a wireline retrievable safety valve.

21. A system for communicating hydraulic control to a wireline retrievable safety valve comprising:

a tubing retrievable safety valve having a hydraulic chamber; and a radial cutting tool selectively locatable within the tubing retrievable safety valve, the radial cutting tool cutting a hole in the tubing retrievable safety valve to create a fluid passageway from the hydraulic chamber to the interior of the tubing retrievable safety valve such that when the wireline retrievable safety valve is positioned within the tubing retrievable safety valve, application of a hydraulic pressure to the wireline retrievable safety valve through the tubing retrievable safety valve actuates the wireline retrievable safety valve.

22. The system as recited in claim 21 wherein the radial cutting tool further comprises a chemical cutting tool.

23. The system as recited in claim 21 wherein the radial cutting tool further comprises a mechanical cutting tool.

24. The system as recited in claim 21 wherein the radial cutting tool further comprises explosive cutting mechanism.

* * * * *